US005803278A

United States Patent [19]

Shiwaku

[11] Patent Number: 5,803,278

[45] Date of Patent: Sep. 8, 1998

[54] OVERHEAD TRAVELING CARRIAGE

[75] Inventor: Tamotsu Shiwaku, Kani, Japan

[73] Assignee: Murata Kikai Kabushiki Kaisha, Kyoto, Japan

[21] Appl. No.: 705,654

[22] Filed: Aug. 30, 1996

[30] Foreign Application Priority Data

Aug. 9, 1995 [JP] Japan ..... 7-257091
Aug. 9, 1995 [JP] Japan ..... 7-257092

[51] Int. Cl.[6] ..... B66C 13/06
[52] U.S. Cl. ..... 212/274; 212/278
[58] Field of Search ..... 212/274; 254/278

[56] References Cited

U.S. PATENT DOCUMENTS 505,064 11/1893 Sawyer ..... 212/274
2,164,128 6/1939 Medenwald ..... 212/274
2,752,120 6/1956 Bogle ..... 212/274
4,883,184 11/1989 Albus ..... 212/274
5,423,438 6/1995 Swanson ..... 212/274

*Primary Examiner*—Thomas J. Brahan
*Attorney, Agent, or Firm*—Armstrong, Westerman, Hattori, McLeland & Naughton

[57] ABSTRACT

An overhead travelling carriage is provided wherein three drums are arranged on a base of a hoist unit along the sides of an imaginary equilateral triangle. Two motors and a brake are arranged along imaginary lines which join the imaginary center of the imaginary equilateral triangle where a hypoid gear of the hoist unit is positioned and the imaginary apices of the imaginary equilateral triangle. The rotation of the hypoid gear is transmitted to a spur gear on the drum side of the spur gear in order to drive the drum. As a result, the hoist unit of the overhead travelling carriage may be reduced in size.

6 Claims, 11 Drawing Sheets

12

12

2

OVERHEAD TRAVELING CARRIAGE

FIELD OF THE INVENTION

The present invention generally relates to an overhead travelling carriage for transporting work products and more particularly, to an overhead travelling carriage having a hoist unit which is reduced in size due to the arrangement of drums, motors, brakes and gears.

BACKGROUND OF THE INVENTION

An overhead travelling carriage is often used in industry to transport both unfinished and finished work products. A conventional overhead travelling carriage typically travels along a running rail arranged on the ceiling of a building and includes a hoist unit on the main body of the carriage to either hoist up or set down the work product being transported. An example of using an overhead travelling carriage for loading is transporting a work product from an above ground station and an example of using an overhead travelling carriage for unloading is transporting the work product loaded in the previous example to another above ground station.

It is generally desirable to have the overhead travelling carriage be as compact as possible. The size of the overhead travelling carriage is especially important, for example, in the field of semi-conductor manufacture because semiconductor circuit boards and chips must be conducted in as clean an environment as possible. In transporting semiconductor circuit boards and chips by an overhead travelling carriage, it is desirable to keep the size of the facilities as small as possible to reduce cleaning cost expenditures. Thus, it is desirable to keep the size of the overhead travelling carriage as small as possible.

Furthermore, conventional overhead travelling carriages have the drawback that the position where loading and unloading can be carried out is restricted to directly below the running rail. Consequently, this causes restrictions on the positioning of the running rail on which the overhead travelling carriage travels, the positioning of the above ground stations and so forth.

It is an object of the present invention to provide an overhead travelling carriage that reduces the size of the hoist unit of the overhead travelling carriage, which increases the permissible range of work positions with respect to the running rail and which can handle work products even in positions not directly below the running rail.

SUMMARY OF THE INVENTION

The present invention provides an overhead travelling carriage having a car that travels, while supported on a running rail. The overhead travelling carriage has a main body that is provided with a hoist unit arranged on the lower part of the car and a work product gripping member or hand that vertically moves due to the hoist unit. A drum and motor are arranged on the base of the hoist unit and a common shaft is arranged in a vertical direction to connect the drive gear and the transmission part. The transmission part is rotated by contact of the motor with the drive gear and the work product gripping member or hand is vertically moved by rotation of the drum by the transmission part. Hypoid gears, bevel gears and similar are used in the drive gear so that the rotation direction of the shaft can be shifted through an angle of 90 degrees. It is preferable that hypoid gears be used in the drive shaft and that the hypoid gears be thin in order to reliably transmit motive power.

It is preferable to position each of three drums at imaginary points forming the imaginary apices of an imaginary equilateral triangle. It is further preferable to position a shaft common to all three drums in the imaginary center of the imaginary equilateral triangle and to position a motor at some point along an imaginary line connecting the imaginary apex of the imaginary equilateral triangle with the imaginary center of the imaginary equilateral triangle.

Further, two motors and a brake (the brake being a separate part from the motors) are positioned along imaginary lines which join the imaginary apices of the imaginary equilateral triangle.

Yet further, the hoist unit is suspended on a lateral movement rail which is positioned on the base of a car at approximately right angles to the movement direction of the car and a delivery system is arranged for moving the hoist unit along the lateral movement rail.

Further still, a main body of the work product gripping member or hand, a rotation plate and a rotation system for rotating the rotation plate with respect to the main body of the work product gripping member or hand are all arranged on the work product gripping member or hand. The main body of the work product gripping member or hand is suspended by the hoist unit and a gripping system is arranged for gripping the work product to be transported to the rotating plate.

Yet further still, the delivery system includes a lateral movement motor, a screw-attached shaft that rotates due to the lateral movement motor and a female screw that engages the screw-attached shaft.

A drum, used for hoisting, and a drive motor are positioned on the base of a hoist unit of the overhead travelling carriage of the present invention. The rotation of the drive motor is changed from a horizontal direction to a vertical direction by a drive gear and is transmitted to the drum by the transmission part. The drive gear and transmission part have a common shaft and are stacked in a vertical direction. Rotation centered about the approximately horizontal direction of the motor is converted to rotation centered about a vertical direction by a drive gear. The transmission part also rotates about a vertical direction. Then, for example, the rotation of the transmission part is transmitted to another gear, the direction of the rotation shaft is converted once again to a horizontal direction by a bevel gear or similar and the drum is driven. A pulley may be used for driving of the drum from the transmission part. Thus, the drive motor and the drum can be positioned at the same height on the base of the hoist unit and the height of the hoist unit can be reduced. Furthermore, the drive gear and transmission part are arranged so as to be above and below each other. Thus, the surface area which the drive gear and transmission part cover can be reduced.

Three drums are positioned in the shape of an imaginary equilateral triangle and a common shaft is positioned in the imaginary center of the imaginary equilateral triangle. Thus, spaces can be formed along the imaginary lines joining the imaginary apices of the imaginary equilateral triangle and the imaginary center of the imaginary equilateral triangle. Thus, the motor can be positioned in the spaces formed along the imaginary lines joining the apices of the imaginary equilateral triangle to the imaginary center of the imaginary equilateral triangle and the dimensions of the hoist unit can be reduced.

As a consequence of providing a brake as a separate part from the two motors, there are a total of three units which can be positioned at the spaces along the imaginary lines joining the imaginary apices at which drums are placed to the imaginary center of the imaginary equilateral triangle. By using two motors, each of the motors can be reduced in size. Also, by providing a brake which is a separate part from either one of the two motors, each of the two motors can be further reduced in size. Furthermore, by positioning the brake and two motors along the imaginary lines joining the imaginary apices to the imaginary center of the imaginary equilateral triangle, the weight of the three drums, two motors and one brake can be positioned equally about the center of the hoist unit so that the unit becomes stable as a result of such weight distribution.

The hoist unit is suspended by a lateral movement rail on a base of a car and moves laterally along the base of the car by a delivery system. Thus, the hoist unit can be moved in a direction at right angles to the running rail and loading can be performed in positions other than directly below the running rail. As a delivery system, a screw-attached shaft and female screw are used. The screw-attached shaft is rotated by a lateral movement motor so that the female screw protrudes and retracts and the hoist unit moves. Besides the female ball screw shown in the embodiment, a simple female screw or similar can be used. In this way, the hoist unit can be laterally moved by a simple reliable system of a screw, shaft and motor. It should be noted that the movement in the direction at right angles to the movement direction of the overhead travelling carriage, i.e., the direction at right angles to the running rail, is called lateral movement.

The work product gripping member or hand includes a main body of the work product gripping member or hand and two members of the rotating plates. The main body of the work product gripping member or hand is suspended from the hoist unit by ropes or similar. The rotating plate is rotated and the work product is gripped by a gripping system. Thus, the main body of the work product gripping member or hand can be suspended stably without rotation with respect to the hoist unit. The rotating plate is rotated to align with the work product and the work product is gripped by the gripping system. Accordingly, a work product facing in any direction can be gripped and since the main body of the work product gripping member or hand does not rotate, the vertical movement of the hoist unit becomes simple.

DETAILED DESCRIPTION OF THE PREFERRED EMBODIMENTS

Figure 1:
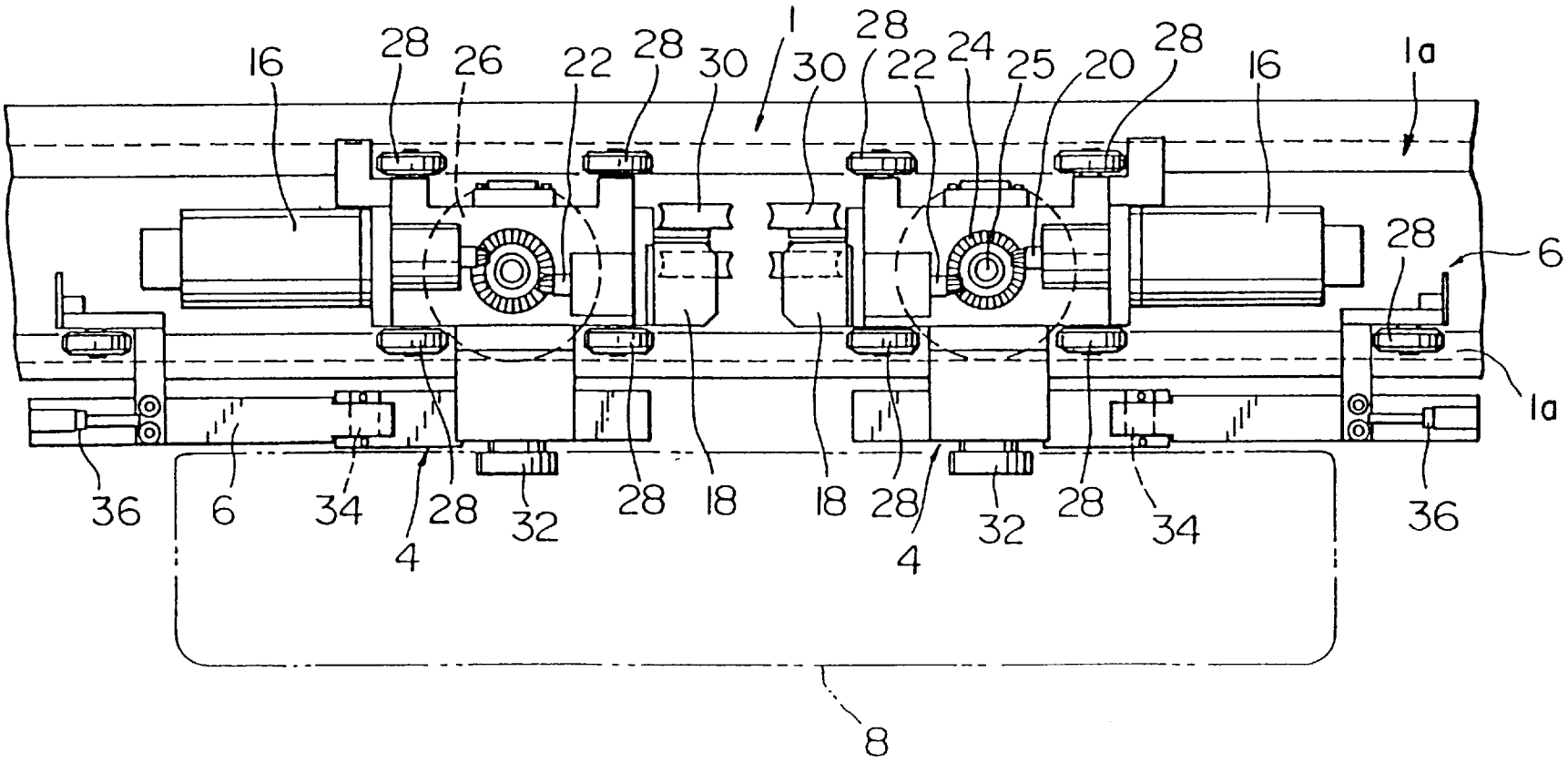
FIG. 1 is a front view of a pair of cars of the overhead travelling carriage of the present invention.

FIGS. 1–14 show different embodiments of the overhead travelling carriage 2 of the present invention. Referring to FIG. 14, the structure of the entire running rail 1, overhead travelling carriage 2, cars 4, bumper 6, main body 8, hoist unit 10 and work product gripping member or hand 12, and anti-drop member 14 is shown. The running rail 1 is arranged along the ceiling 7 of a building in a factory or a clean room. The running rail 1 includes a rail part 1*a* and a communication cable 3. The communication cable 3 is arranged between the overhead travelling carriage 2 and the control center (not shown). The overhead travelling carriage 2 is provided with a pair cars 4 and each car 4 is provided with a bumper 6.

Figure 2:
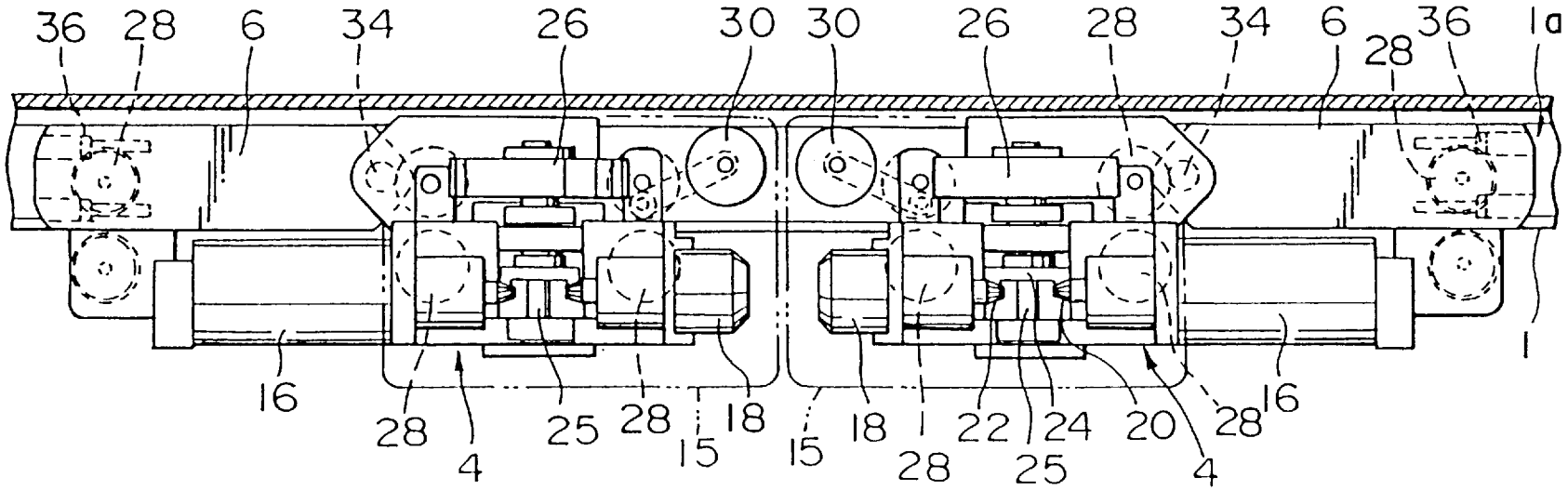
FIG. 2 is a plan view of the cars of the overhead travelling carriage of the present invention.
Figure 3:
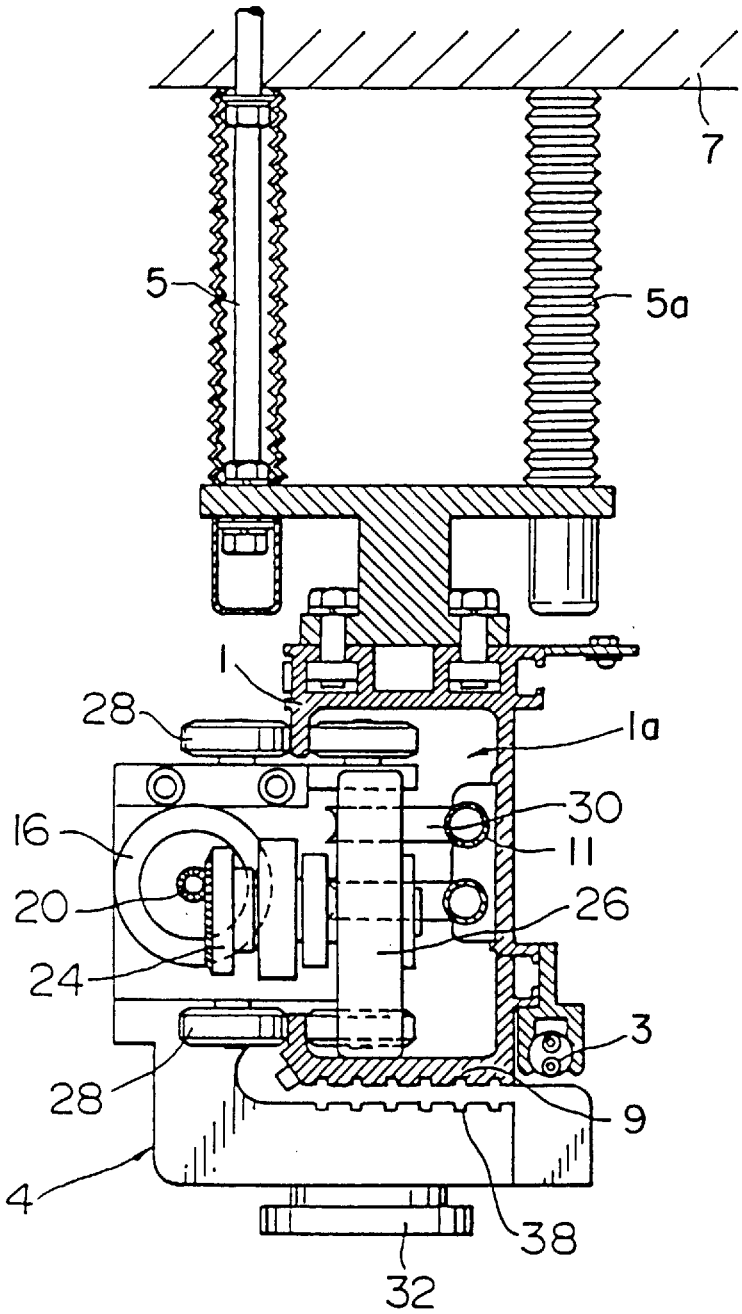
FIG. 3 is a vertical cross-sectional view of a car of the overhead travelling carriage of the present invention.

As shown in FIGS. 1–3, the cars 4 are connected to the main body 8 by pivot shafts. A hoist unit 10 is suspended from the underside of the main body 8. The hoist unit 10 moves a work product gripping member or hand 12 vertically up and down. The work product gripping member or hand 12 is capable of gripping, holding and transporting a work product W such as a Standard Mechanical Interface or SMIF pod containing semi-conductor circuit boards. A pair of anti-drop members 14 are provided for preventing dropping of the work product W when the work product gripping member or hand 12 is hoisted and the work product W is being transported.

Hereinafter, a car 4 will be described.

FIG. 1 shows the structure of the cars 4 as seen vertically and laterally in the direction that the overhead travelling carriage 2 travels. FIG. 2 shows the cars 4 as they would look if viewed from the ceiling 7. FIG. 3 shows a vertical cross-section of the car 4 on the running rail 1. A cover 15, or similar, which covers each of the cars 4 is not shown, in either of FIGS. 1 and 3, and only the outer periphery of the cover 15 is shown in FIG. 2 in dashed lines, in order to show the inner details of each of the cars 4. FIG. 3 shows the attachment of the car 4 to the running rail 1 and support members 5 of the running rail 1. The support members 5 are so arranged to allow adjustment of the distance of the running rail 1 from the ceiling. The support members 5 are each covered by a cover 5*a*. A contact wire 11 is shown for supplying electricity to the overhead travelling carriage 2 and a mark 9 is shown for transmitting the stop position and similar to the overhead travelling carriage 2.

As shown in FIGS. 1–3, a running motor 16 is horizontally arranged along the longitudinal direction of each car 4 so as to be approximately parallel with the running rail 1. The running motor 16 has a motor shaft 20 which is approximately horizontal or at least within a ±10 degree range from the horizontal. No brake is arranged on the motor shaft 20, but a brake 18, such as an electromagnetic brake or similar, is separately provided. The brake 20 has a brake shaft 22. The motor shaft 20 and the brake shaft 22 are connected to a hypoid gear 24. The hypoid gear 24 drives the running wheels 26 by changing the direction of rotation of the shafts 20, 22 through a 90 degree angle. It should be noted that the rotating surface of the running wheels 26 as shown in FIG. 3 is vertical, but may be horizontal.

A guide roller 28 is shown for preventing each of the cars 4 from separating from the running rail 1 and main body 8. A guide roller 28 is arranged on the end of the bumper 6 so that the bumper 6 runs smoothly along the running rail 1.

A current collector 30 is provided and rotates freely around a vertical shaft. The current collector 30 receives electricity from the contact wire 11, and supplies power to the running motor 16 or similar.

Pivot shafts 32 are provided to connect each of the cars 4 to the main body 8 of the overhead travelling carriage 2. As a result, a pair of cars 4 form a bogey car (i.e., a car, through an axis of which, two or more cars are connected and two or more cars are winding free) with respect to the main body 8. Also, pivot shafts 34 are provided to connect the bumpers 6 with the cars 4 and are connected to the covers 15 of the cars 4. The bumper 6 travels on the running rail 1 by means of the guide roller 28. The direction that the bumper 6 faces with respect to the car 4 can be changed by means of the pivot shaft 34. A proximity sensor 36 is arranged on the end of the bumper 6. The proximity sensor 36 detects any car 4 or other obstacle which is in the path of the car 4 on which the proximity sensor 36 is located. A read sensor 38 is arranged opposite to the mark 9 and detects the stopping position by supplementing the control data stored in the main body 8 of the overhead travelling carriage 2.

Hereinafter, the characteristics of the car 4 will be described.

It is important for any overhead travelling carriage 2, which is to be used in a room or other environment that must be kept as clean as possible, to be small in size and compact in volume. As the space allotted to the overhead travelling carriage 2 along the longitudinal direction of the running rail 1 is reduced, it is important to correspondingly reduce the width and height of the car 4 with respect to the running rail 1. The present embodiment has the running wheel 26 near the center of each car 4 in the longitudinal direction. On one side of the running wheel 26, the running motor 16 is provided and on the other side of the running wheel 26, the brake 18 is provided.

Furthermore, the running motor 16 partially protrudes from the car 4. The motor shaft 20 and the brake shaft 22 are approximately horizontal or at least within a range of ±10 degree from the horizontal. If the shafts 20, 22 are somewhat inclined from the horizontal, any angle of deviation from the horizontal that the shafts 20, 22 are inclined, is parallel with the direction of travel of the cars 4. Thus, the longitudinal direction of the motor 16 and the brake 18 are parallel to the longitudinal direction of the running rail 1 and the height and width of the car 4 are reduced. The motor shaft 20 and the brake shaft 22 are connected to a hypoid gear 24. The hypoid gear 24 drives the running wheels 26 by changing the direction of the rotation of the shafts 20, 22 through an angle of 90 degrees.

It should be stated that the shaft direction of the hypoid gear 24 and the shaft directions of the motor shaft 20 and the brake shaft 22 do not cross. In fact, as shown in FIG. 1, for example, the directions of the motor shaft 20 and the brake shaft 22 are positioned parallel to each other (i.e., do not converge). Furthermore, by using the hypoid gear 24, which is a relatively thin gear as compared to a bevel gear, the motive force can be more reliably transmitted. As a result of the thickness of the gearing being reduced, the height of the car 4 can be reduced.

The running motor 16 and the brake 18 are formed as separate parts and are positioned approximately opposite to each other with the running wheel 26 in the center. Because the running motor 16 and the brake 18 are formed as separate parts, the running motor 16 can be reduced in size and the weight of each can be distributed to each side of the running wheels 26. Conversely, if the brake 18 and the running motor 16 were unified, the running motor 16 would necessarily be increased in size and moreover, the running wheels 26 would have to be positioned approximately in the center of the car 4 such that the car would be increased in size. Furthermore, the weight would become concentrated at one end of the car 4 and such concentration of the weight would cause instability.

Figure 4:
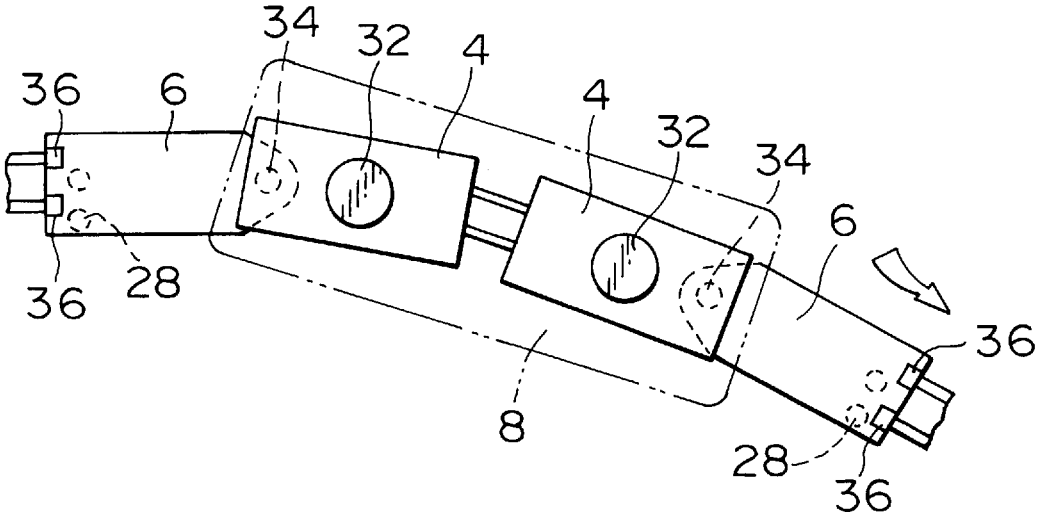
FIG. 4 is a plan view showing the running state of the cars of the overhead travelling carriage of the present invention at a curve.

Next, each of the pair of cars 4 are separated from and joined to the main body 8 by the pivot shafts 32. Because the running motor 16, or similar, is arranged on each of the pair of cars 4, the diameter of the running motor 16 and the brake 18 can be reduced in size and thus, the height and width of each of the cars 4 can be reduced. Furthermore, since each of the pair of cars 4 are connected to the main body 8 by a pivot connection, the overhead travelling carriage 2 can smoothly turn a corner as shown in FIG. 4 so that the vibration of the work product W is small.

Furthermore, since the front and back bumpers 6 are connected to each of the cars 4 by means of the pivot shafts 34, the bumpers 6 turn with respect to the cars 4 in the direction of the running rail 1. The bumpers 6 also reliably detect any car 4 or other obstacle in the path of the overhead travelling carriage 2 by means of the proximity sensor and thus, prevent any collision of cars 4 on the running rail 1 with cars 4 on the lateral movement rails 78. Contrarily, if the bumpers 6 are not connected to the cars 4 by means of a pivot connection, the direction in which the proximity sensor 36 faces is fixed in the direction in which the car 4 faces and thus leading to an inability to detect any overhead travelling carriage 2 on a curve ahead.

Next, the hoist unit 10 will be described.

Figure 5:
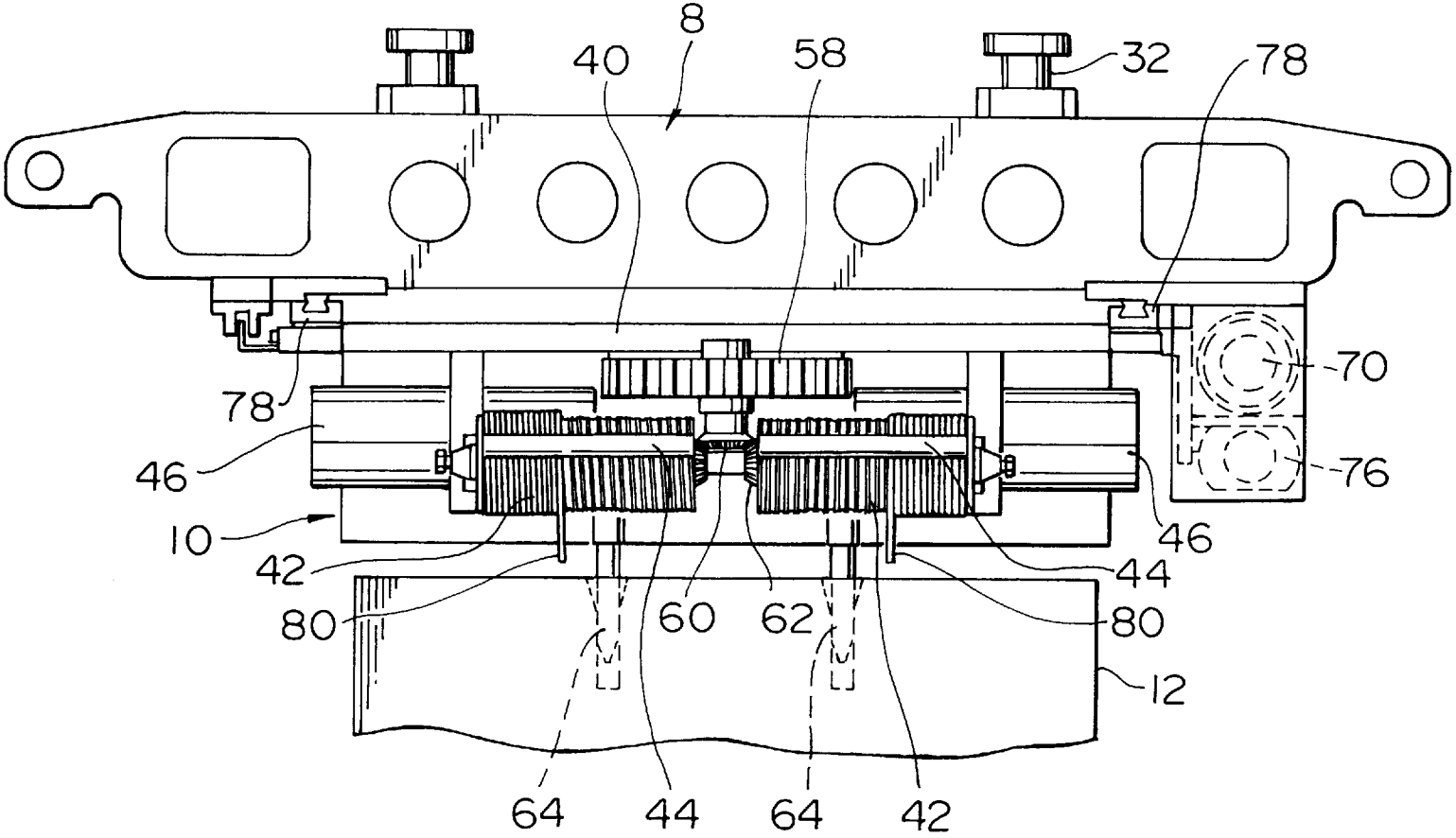
FIG. 5 is a front view of a hoist unit of the overhead travelling carriage of the present invention.
Figure 6:
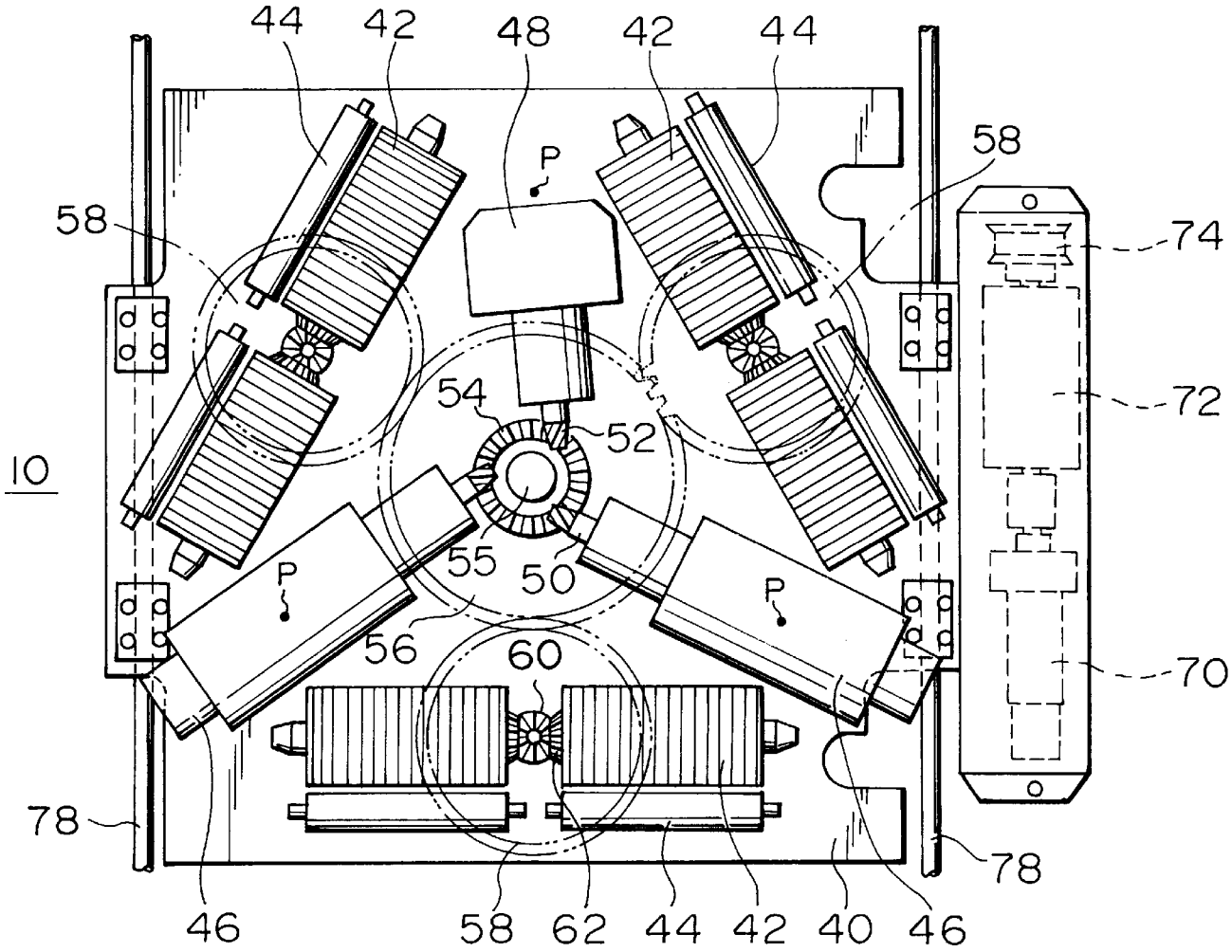
FIG. 6 is a bottom view of the hoist unit of the overhead travelling carriage of the present invention.
Figure 7:
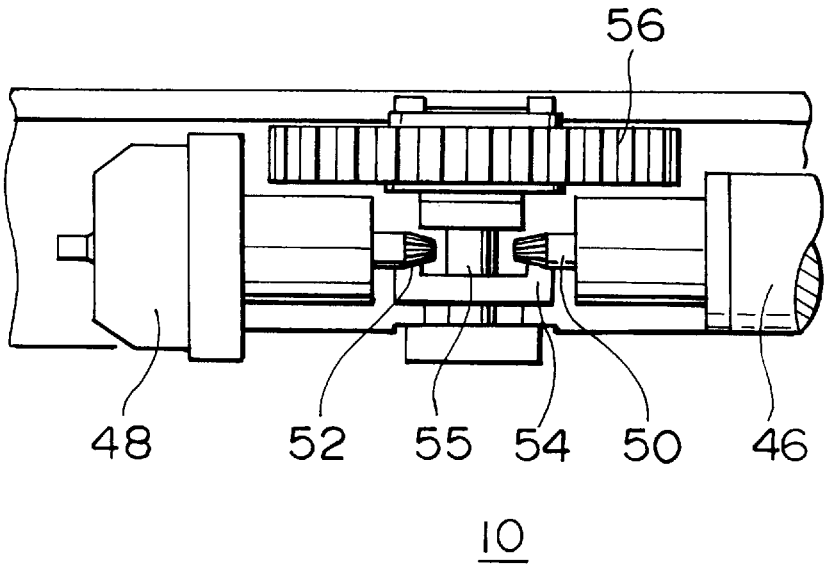
FIG. 7 is a right side view showing the connection between the motor, the brake and the hypoid gear of the hoist unit of the overhead travelling carriage of the present invention.

FIGS. 5–7 show the hoist unit 10 of the present embodiment. The hoist unit 10 is suspended from the underside of the main body 8. A hoist unit base 40 and three hoist unit drums 42 are also positioned on the underside of the main body 8. Each hoist drum 42 is divided into two parts so that one drum 42 hoists two ropes 80 or belts or tapes. Thus, the work product gripping member or hand 12 is hoisted using a total of six ropes 80. The hoist drums 42 are positioned at the imaginary apices P of an imaginary equilateral triangle and anti-detachment rollers 44 are positioned adjacent each hoist drum 42 outside of said imaginary equilateral triangle. The anti-detachment rollers prevent the ropes 80 from detaching from the hoist drums 42.

Two sets of hoist motors 46 are arranged separately from the brake 48. The brake 48 is preferably a magnetic brake, but other types of brakes may be used. A motor shaft 50 and the brake shaft 52 are positioned approximately horizontally, but may vary within a range of ±10 degrees from the horizontal. As a result of this, the hoist motors 46 and the brake 48 are arranged at roughly the same height as the drums 42 and are approximately horizontal. A drive gear such as a hypoid gear 54 is arranged in the center of the hoist unit 10. In other words, the hypoid gear 24 is positioned in the imaginary center C of an imaginary equilateral triangle formed by the placement of three drums 42 at the imaginary apices P of the imaginary equilateral triangle. A spur gear 56 used for transmission is arranged on a common shaft 55 with the hypoid gear 54.

The hypoid gear 54 converts the rotation of the hoist motor 46 about a horizontal direction into a rotation about a vertical direction. A bevel gear may be used instead of the hypoid gear 54, however, because the hypoid gear 54 is thin and can reliably transmit the motive force, the hypoid gear 54 is preferable. The spur gear 56 drives the drum 42 via the drum 42 side spur gear 58. A bevel gear 62 is arranged on the rotation shaft of the spur gear 58. Thus, the bevel gear 62 of the drum 42 is rotated. A helical gear or similar may be used in place of the spur gear 58. A guide pin 64 is used for positioning the work product gripping member or hand 12.

By referring to FIG. 6, the operations of the hoist unit 10 will be described.

The ropes 80 are attached to three points $P_1$, $P_2$, $P_3$ of the work product gripping member or hand 12. Each rope 80 is divided in half from each point $P_1$, $P_2$, $P_3$ to extend upwardly in order to be wound onto drums 42 which are positioned along sides of an imaginary equilateral triangle. In the lowest position of the work product gripping member or hand 12, the ropes 80 at each point $P_1$, $P_2$, $P_3$ are connected on the inside of the drum 42, but the ropes 80 move towards the outer side of the drum 42 as hoisting progresses. As a result, the ropes 80 form an isosceles triangle with each point $P_1$, $P_2$, $P_3$ as an apex so that the spacing of the hoisting position of the two drums 42 is reduced as the work product gripping member or hand 12 rises. Due to this, the spacing of the hoisting position increases when the work product gripping member or hand 12 is lowered and decreases as the work product gripping member or hand 12 is raised. The angle formed by the two ropes 80 fixed at each point $P_1$, $P_2$, $P_3$ is approximately uniform regardless of the vertical movement of the work product gripping member or hand 12. Thus, a work product W can be stably gripped by the work product gripping member or hand 12 regardless of the vertical position of the work product gripping member or hand 12 and moreover, the torque necessary for hoisting is approximately uniform. In short, the larger the angle formed by the two ropes 80, the more stable the work product gripping member or hand 12 can grip, but conversely, the torque necessary for hoisting increases. In the present embodiment, the angle formed by the two ropes 80 is nearly uniform regardless of the height of the work product gripping member or hand 12 and the work product gripping member or hand 12 stably hoists and lowers the work product W under an approximately uniform torque. Furthermore, since the present embodiment uses six ropes 80 to vertically move the work product gripping member or hand 12, the work product gripping member or hand 12 does not tilt and the work product W can be stably transported even if one of the ropes 80 breaks or is severed.

Next, attention will be paid to the size of the hoist unit 10. As clearly shown in FIGS. 5 and 6, the positions in the vertical direction of the hoist motors 46 and the drums 42 are aligned and are positioned approximately horizontally. Thus, the height of the hoist unit 10 can be reduced. Furthermore, because the hypoid gear 54 and the spur gear 56 are arranged to be vertically stacked with respect to each other, the surface area taken up by the hypoid gear 54 and spur gear 56 is lessened. With regard to the transmission of the rotation from the hoist motor 46, the rotation of the hoist motor 46 having an approximately horizontal rotation shaft is changed by approximately 90 degrees by the hypoid gear 54, transmitted to the spur gears 56, 58 and is transmitted to the drum 42 by changing it once again to a horizontal rotation by the bevel gears 60, 62.

The three drums 42 are arranged along imaginary sides of an imaginary equilateral triangle and a space is generated along an imaginary line joining each of the imaginary apices P of the imaginary equilateral triangle and the imaginary center C of the imaginary equilateral triangle where the hypoid gear 54 is located. The hoist motors 46 and the brake 48 are positioned along the imaginary lines joining the imaginary apices P of the imaginary equilateral triangle to the imaginary center C of the imaginary equilateral triangle. Thus, the dimensions of the hoist unit 10 may be minimized. Furthermore, since the brake 48 is separate from the hoist motors 46, the size of each of the motors 42 can be reduced. Moreover, as the drums 42, the motors 46, and the brake 48 are arranged equally about the hypoid gear 54 at the imaginary center C of the imaginary equilateral triangle, the weight of the hoist unit 10 is distributed equally. As a result, the lateral movement of the hoist unit 10 using the lateral movement rails 78, which will be described further below, is simplified.

Hereinafter, the lateral movement of the hoist unit 10 will be described.

Figure 8:
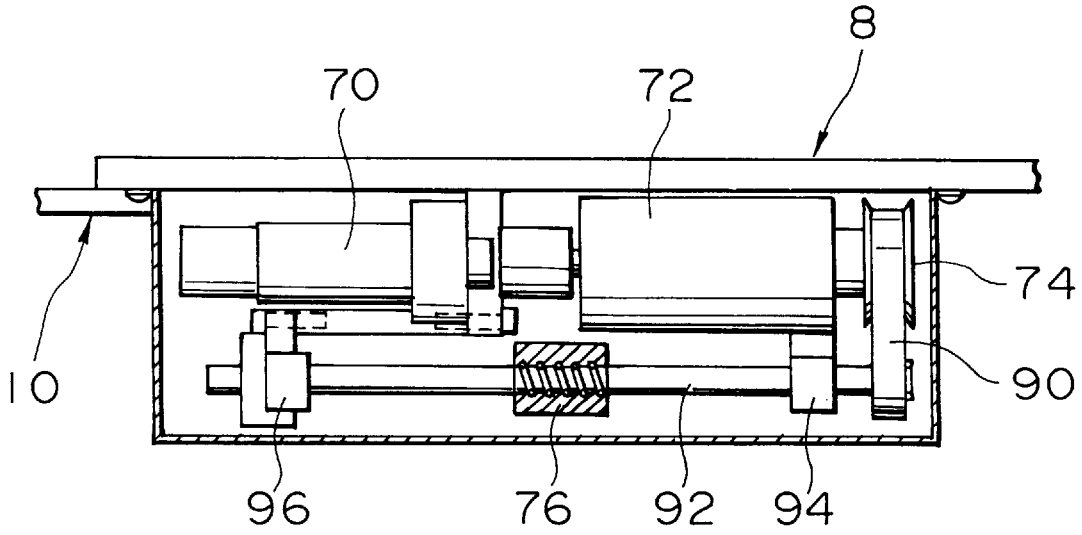
FIG. 8 is a left side view showing the connections of the lateral movement motor of the hoist unit of the overhead travelling carriage of the present invention.

In FIGS. 5, 6, and 8, a lateral movement motor 70 is shown for laterally moving the hoist unit 10 with respect to the main body 8. A brake 72 and a pulley 74 are shown. The pulley 74 is driven by the rotation of the lateral movement motor 70. A belt 90 is attached to the pulley 74 which in turn rotates a screw-attached shaft 92. Bearings 94, 96 and a female ball screw 76 are shown. The female ball screw 76 is affixed to the hoist unit 10, while all other parts are affixed to the main body 8. It is possible that the female ball screw 76 may be attached to the main body 8 and all other parts may be attached to the hoist unit 10, however, attachment of many parts to the hoist unit 10 is undesirable, because it is preferred to keep the weight of the hoist unit 10 to a minimum. In generic terms, these are known as the hoist system H and the delivery system D. It should be noted that a simple cylindrical female screw may be used in place of the female ball screw 76. Furthermore, lateral movement rails 78, shown in FIGS. 5 and 6, are arranged on the base of the main body 8 so as to extend in front of and behind the female ball screw 76, and are so arranged that the hoist unit 10 is able to move along the lateral movement rails 78.

In this way, the female ball screw 76 advances and retracts along the screw-attached shaft 92 due to the rotation of the lateral movement motor 70 and the hoist unit 10 moves along the lateral movement rails 78. Accordingly, the work product W, positioned in a place not directly below the running rail 1, can be loaded and the restrictions concerning the positioning of the work product W can be relaxed. This also means that the restrictions with regard to positioning of the above ground station (not shown in the drawing figures) can be relaxed so that an above ground station may be positioned in any desired place. Furthermore, the freedom with regard to the positioning of the running rail 1 increases and layout of the running rail 1 is simplified.

The range with which the hoist unit 10 is able to move laterally with respect to the running rail 1 is kept within the range where the car 4 does not slant due to changes in the position of the center of gravity. The more stable the attachment of the car 4 on the running rail 1, the larger the increase in the range of possible lateral movement. Furthermore, with respect to the present embodiment, as the main body 8 is separate from the cars 4, the lateral movement rails 78 are arranged on the main body 8. However, if the main body 8 and the car 4 are a single, one-piece body, the lateral movement rails 78 are arranged on the base of the car 4.

Hereinafter, the work product gripping member or hand 12 will be described with respect to FIGS. 9–13.

Figure 9:
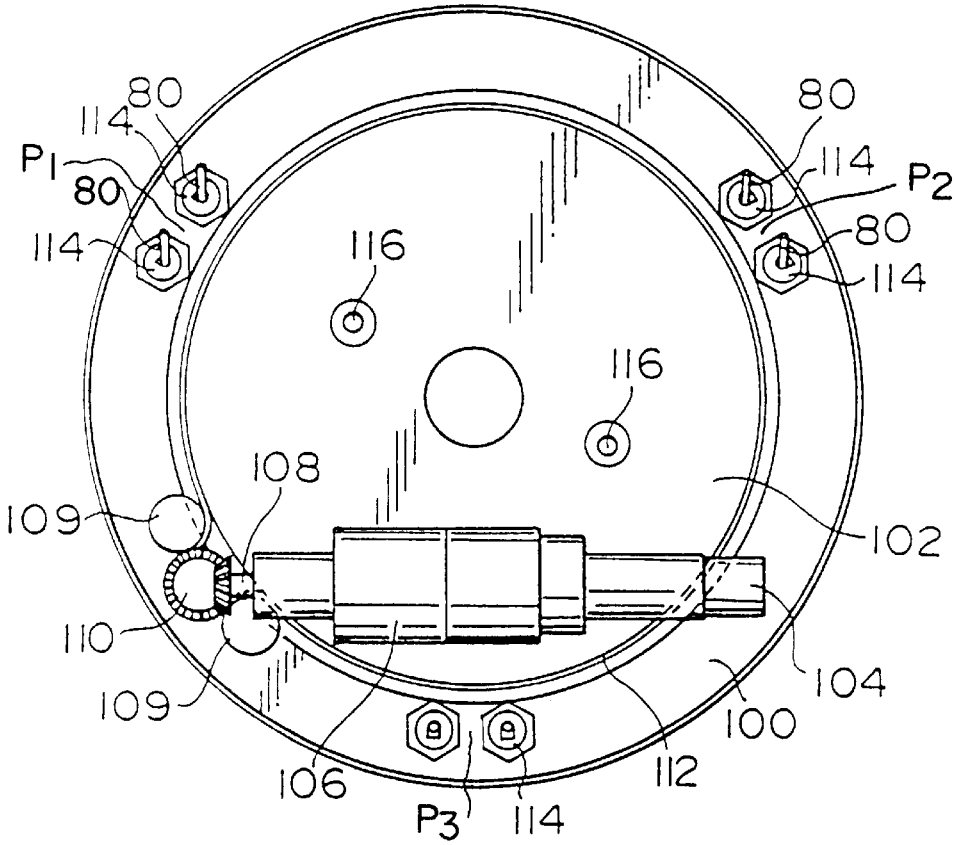
FIG. 9 is a plan view of the main body of the work product gripping member or hand which is suspended on ropes from the hoist unit of the overhead travelling carriage of the present invention.
Figure 10:
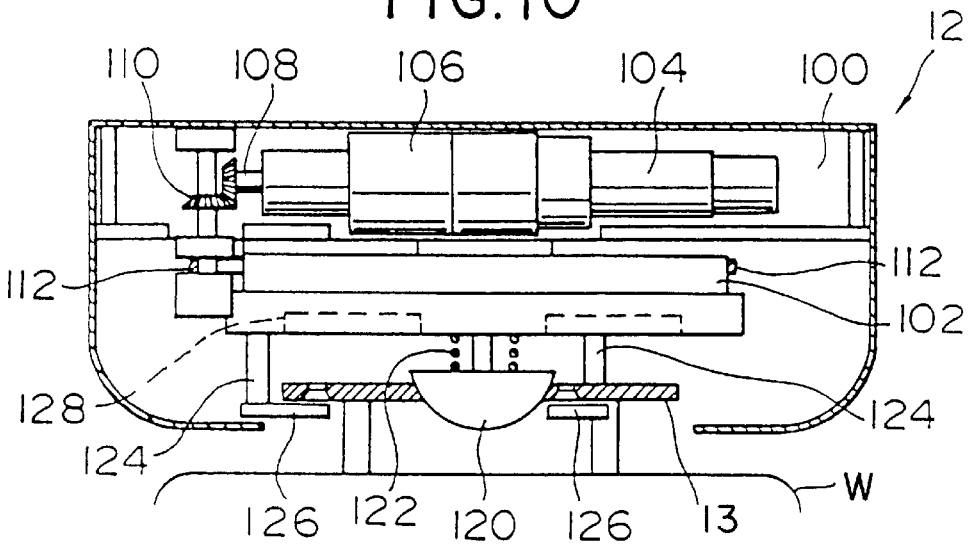
FIG. 10 is a front view of the work product gripping member or hand of FIG. 9.

In FIGS. 9 and 10, a hand main body 100 is shown which is suspended from the hoist unit 10 by ropes 80. A rotation plate 102 is shown which rotates by a motor 104 with respect to the hand main body 100. A brake 106, a shaft 108, and a bevel gear 110, are shown. The bevel gear 110 is connected to the shaft 108, drives a toothed belt 112 by rotating a belt drive gear (not shown in the drawing figures) and rotates the rotation plate 102. A tension roller 109 applies tension to the toothed belt 112. The tension roller 109 also guides the belt 112 rolled in the belt drive gear having the same axis as the bevel gear 110. An attachment part 114 for connection of the ropes 80 at points $P_1$, $P_2$, $P_3$, and positioning holes for the guide pin 64 are shown.

As shown in FIG. 10, an approximately semi-spherical centering member 120 and a spring 122, which pushes the centering member 120 downwards, are arranged on the rotation plate 102. The centering member 120 and the spring 122 are aligned with a hole arranged in the center of a support plate 13 of the work product W and carry out centering. Furthermore, three pairs of claws 126 may be arranged on the rotation plate 102 to be rotated about claw shafts 124 and to be aligned with holes arranged on the support plate 13.

Figure 11:
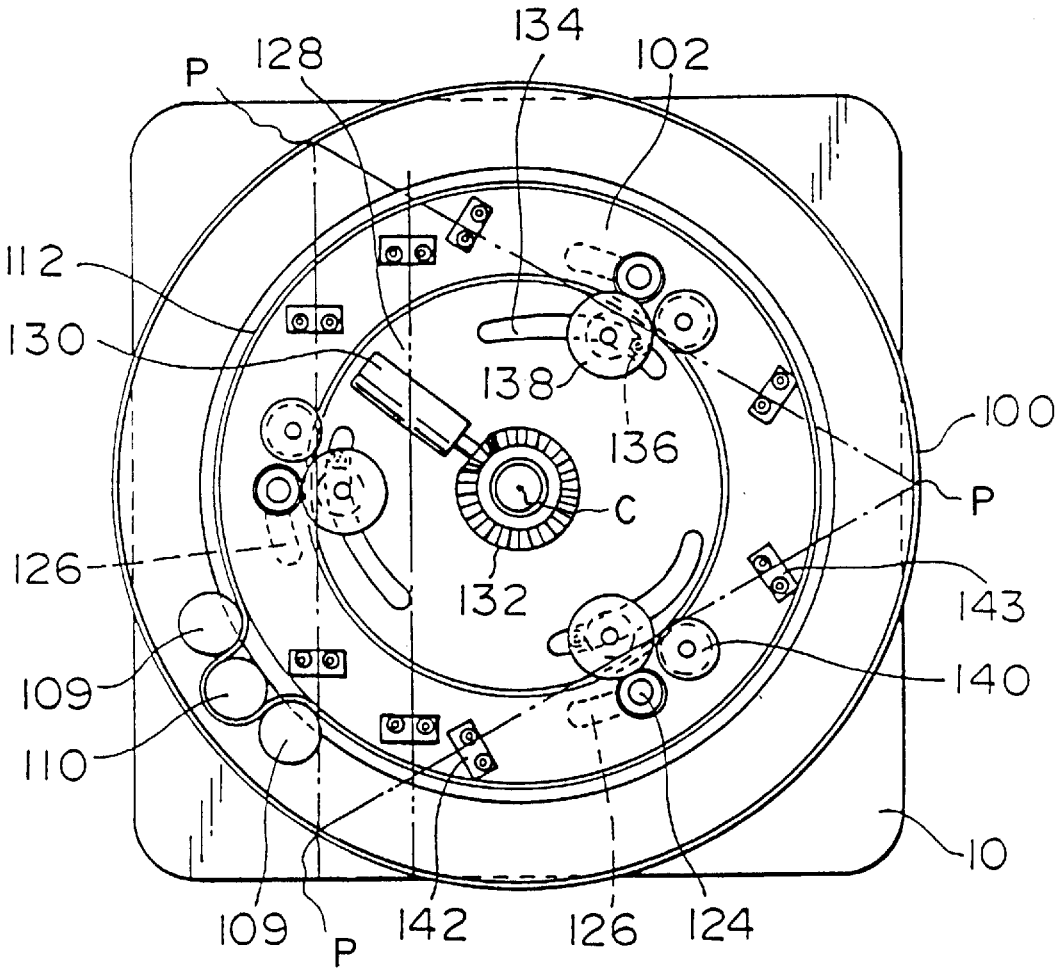
FIG. 11 is a bottom view of the work product gripping member or hand of FIG. 9, along the direction of the cam plate.
Figure 12:
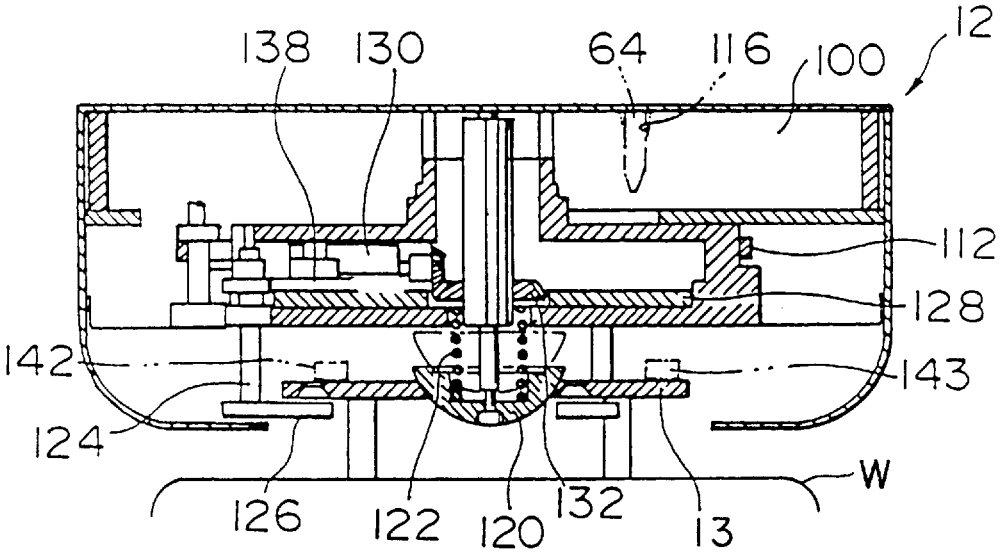
FIG. 12 is a cross-sectional view of the work product gripping member or hand of FIG. 10.

FIGS. 11 and 12 show the parts related to the claw 126. A cam plate 128 is arranged on the inside of the rotation plate 102. The cam plate 128 is a plate for operating the three sets of claws 126 by means of one driving source and is used to simplify the driving mechanism of the claw 126. A motor 130 with a brake or similar attached is shown. A bevel gear 132 is arranged in the center of the cam plate 128. A cam groove 134 is shown. The cam plate 128 is rotated by the bevel gear 132 by the rotation of an internal motor 130. A roller 136 is positioned in the cam groove 134 and rotates in connection with the rotation of the cam plate 128. The rotation of the roller 136 is transmitted to the gear 138 which engages a cog arranged on the claw shaft 124 and rotates the claw 126. The cam groove is a groove 134 which moves the roller 136 installed in the cam groove 134 by rotation of the cam plate 128 and rotates the gear 138. By the rotation of gear 138, the claw shaft 124 rotates and the claw 126 rotates. The roller 136 only has to be moved in the cam groove 134 so that the claw 126 may rotate, but the shape of the cam groove 134 has no special meaning. A guide roller 140 is shown for smoothly rotating the cam plate 128.

In order to detect the position of the support plate 13, a position sensor S comprising a light emitting part 142 and a light receiving part 143 is arranged so that the light beam is slightly higher than the projection of the claw 126. In short, until the projection on the end of the claw 126 is inserted into the hole of the support plate 13, the support plate 13 is in a slightly floating position and intersects the light beam of between the light emitting part 142 and the light receiving part 143. In contrast to this, when the projection on the end of the claw 126 is inserted into the holes of the support plate 13, the position of the support plate 13 becomes relatively lower and light from the light emitting part 142 can be received at the light receiving part 143. Accordingly, detection of whether the support plate 13 has been completely gripped by the claw 126 is carried out. It should be stated that the present embodiment uses light passing from the light emitting part 142 to the light receiving part 143, however, detection of light reflected from the support plate 13 by the light receiving part 143 is acceptable or the position of the support plate 13 may be detected by a distance sensor such as a high frequency sensor.

Figure 13:
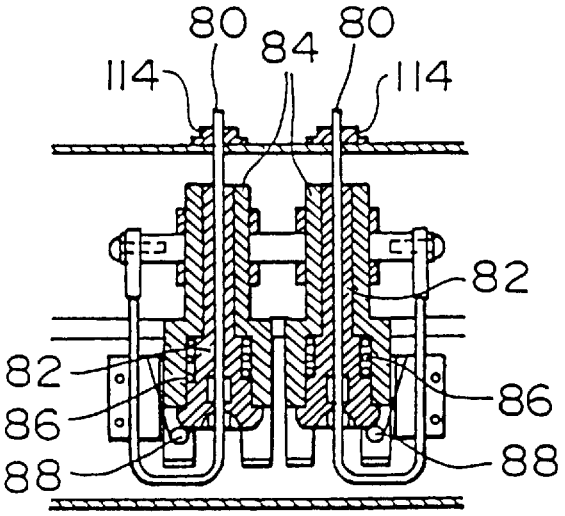
FIG. 13 is a cross-sectional view of the loading detection system of the work product gripping member or hand.
Figure 14:
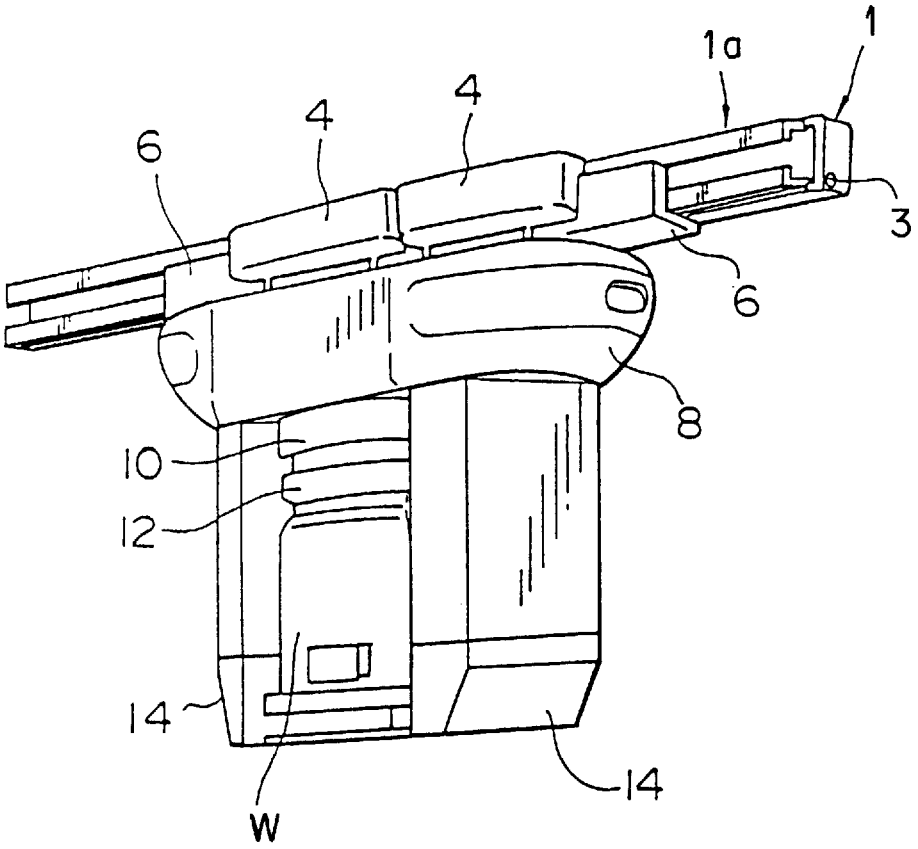
FIG. 14 is a perspective view of the overhead travelling carriage of the present invention.

FIG. 13 shows the landing detection system of the work product gripping member or hand 12. When the hand 12, as shown in FIG. 14, descends and contacts the work product W, it is necessary to stop the drum 42 by means of the brake 48 and ensure that the rope 80 does not sag. In the rope attachment part 114 of the work product gripping member or hand 12, the rope 80 is fixed to the rope gripping member 82, is stored inside the casing 84 and pushed downwards by the spring 86. Thus, when the hand 12 descends and contacts the work product W positioned at the above ground station, an upwards force is applied to the work product gripping member or hand 12 from the work product W and the rope gripping member 82 moves downwards due to the force of the spring 86. The position of the rope gripping member 82 is monitored by a limit switch 88 and when the rope gripping member 82 moves downwardly, the limit switch 88 detaches and detection of the landing of the work product gripping member or hand 12 is performed. When the landing of the work product gripping member or hand 12 is detected, a contact is made to the main body 8 by a line (not shown in the drawing figures). The brake 48 is operated by a control circuit and both the hypoid gear 54 and the drum 42 are fixed. It should be noted that monitoring of the position of the rope gripping member 82 may be carried out by using a proximity sensor PS in place of the limit switch 88.

The operations of the work product gripping member or hand 12 will be described hereinafter.

Before loading, the rotation plate 102 is rotated so that it is facing in the correct direction with respect to the work product W. When the work product gripping member or hand 12 descends, the centering member 120 connects with the hole arranged in the support plate 13 and the position of the work product gripping member or hand 12 with respect to the work product W is minutely adjusted by the centering member 120 and centered. In this embodiment, the semi-spherical centering member 120 is used, but it need not be semi-spherical and may be convex with a smooth end. Furthermore, a centering projection may be arranged on the support plate 13 and a hole may be arranged on the work product gripping member or hand 12 to connect with the centering projection.

When the centering is completed, the cam plate 128 is rotated by the motor 130 and the roller 136 is rotated along the cam grooves 134. This rotation is converted into the rotation of the gears 138, the claw shaft 124 is rotated, the claw 126 rotates from the outer side of the work product W to the inner side and connects with the hole arranged on the support plate 13. Thus, until the projections on the end of the claws 126 are inserted into the holes of the support plate 13, the support plate 13 is in a slightly floating position and intersects the light beam between the light emitting part 142 and the light receiving part 143. Therefore, incomplete gripping is detected. Similarly, during the transportation of the work product W, if the connection of the claw 126 and the support plate 13 is broken, detection would still be possible as the light beam between the light emitting part 142 and the light receiving part 143 would be interrupted.

In the present embodiment, the structure of the car 4 and the hoist unit 10 have been described in detail, but these structures are optional.

What is claimed is:

1. An overhead travelling carriage comprising:

a pair of cars supported by and movable backwards and forwards on a rail, wherein said rail is arranged along a ceiling of a building in which a work product must be transported, said rail including a rail part and a communication cable between said overhead travelling carriage and a control center;

a bumper provided to each car;

a main body connected to said pair of cars via a pivot shaft;

a hoist unit attached to a lower part of said main body;

means for gripping said work product, wherein said gripping means moves vertically up and down relative to said rail due to said hoist unit;

a plurality of drums and a plurality of motors located on a base of said hoist unit, wherein said arrangement is centered around a common shaft in a vertical direction of an object connecting a hypoid gear and a spur gear, wherein said motor is connected to said hypoid gear so as to rotate said spur gear, and said gripping means is vertically moved by rotation of said drum by said spur gear.

2. The overhead travelling carriage as in claim 1, wherein each of three drums of said plurality of drums are arranged along each side of an imaginary equilateral triangle so that said common shaft is positioned at a center of said imaginary equilateral triangle and two motors of said plurality of motors are positioned along a first and second imaginary line joining a first and second apex of said imaginary equilateral triangle to said center of said imaginary equilateral triangle.

3. The overhead travelling carriage as in any one of claims 1 and 2, wherein a brake is arranged along a third imaginary line joining a third apex of said imaginary equilateral triangle to said center of said imaginary equilateral triangle.

4. The overhead travelling carriage as in claim 1, wherein said hoist unit is suspended on a lateral movement rail positioned at a base of each of said cars at approximately right angles to a direction of movement of each of said cars and means for moving said hoist unit along said lateral movement rail is included, said moving means being a delivery system.

5. The overhead travelling carriage as in claim 4, wherein a main body of said gripping means, a rotation plate and means for rotating said rotation plate with respect to said main body of said gripping means are all arranged on said gripping means such that said main body of said gripping means is suspended by said hoist unit and a gripping system is arranged for gripping work products being transported on said rotating plate.

6. The overhead travelling carriage as in any one of claims 4 and 5, wherein said delivery system comprises a lateral movement motor, a screw-attached shaft which rotates due to said lateral movement motor and a female ball screw that engages said screw-attached shaft.

* * * * *